US011713729B2

(12) United States Patent
Liu et al.

(10) Patent No.: US 11,713,729 B2
(45) Date of Patent: Aug. 1, 2023

(54) PISTON FOR SPLITTING INTERNAL COOLING RUNNER

(71) Applicants: MAHLE Automotive Technologies (China) Co., Ltd., Shanghai (CN); Mahle International GmbH, Stuttgart (DE)

(72) Inventors: Junzhuo Liu, Shanghai (CN); Zhenfei Ma, Shanghai (CN); Defeng Song, Shanghai (CN); Siyan Wang, Shanghai (CN)

(73) Assignees: MAHLE AUTOMOTIVE TECHNOLOGIES (CHINA) CO., LTD.; MAHLE INTERNATIONAL GMBH

( * ) Notice: Subject to any disclaimer, the term of this patent is extended or adjusted under 35 U.S.C. 154(b) by 0 days.

(21) Appl. No.: 17/486,809

(22) Filed: Sep. 27, 2021

(65) Prior Publication Data

US 2022/0112861 A1 Apr. 14, 2022

(30) Foreign Application Priority Data

Sep. 27, 2020 (CN) ..... 202011032575.3

(51) Int. Cl.
*F02F 3/22* (2006.01)

(52) U.S. Cl.
CPC ..... *F02F 3/22* (2013.01)

(58) Field of Classification Search
CPC ..... F02F 3/22
See application file for complete search history.

(56) References Cited

U.S. PATENT DOCUMENTS 3,349,672 A 10/1967 Meier
5,483,869 A * 1/1996 Bock ..... F02F 3/0069 92/158
5,839,351 A * 11/1998 Nakada ..... F02F 3/00 92/236
6,279,455 B1 * 8/2001 Kruse ..... F02F 3/003 92/186
6,532,913 B1 * 3/2003 Opris ..... F02F 3/22 123/41.35

(Continued)

FOREIGN PATENT DOCUMENTS

CH 438838 A 6/1967
CN 103649509 A 3/2014

(Continued)

OTHER PUBLICATIONS

Chinese Search Report dated Aug. 16, 2022 for copending Chinese App. No. CN202011032575.3.

(Continued)

*Primary Examiner* — Kurt Philip Liethen
(74) *Attorney, Agent, or Firm* — Fishman Stewart PLLC

(57) ABSTRACT

A piston may include a splitting internal cooling runner, an end portion recessed inward to form a combustion chamber, and an annular internal cooling runner at least partially surrounding the combustion chamber. A wall of the annular internal cooling runner may partially protrude in a direction away from the end portion to form an annular splitting portion which divides the annular internal cooling runner into an outer half cavity and an inner half cavity.

20 Claims, 7 Drawing Sheets

(56) References Cited

U.S. PATENT DOCUMENTS

| | | | | |
|---|---|---|---|---|
| 7,299,772 | B1 * | 11/2007 | Hardin | F02F 3/22 123/41.35 |
| 8,011,288 | B2 * | 9/2011 | Gniesmer | F02F 3/22 92/217 |
| 8,973,548 | B2 * | 3/2015 | Andreas | F02F 3/225 123/193.2 |
| 9,109,530 | B2 | 8/2015 | Bischofberger | |
| 9,404,439 | B2 * | 8/2016 | Klein | F02F 3/16 |
| 11,067,033 | B2 * | 7/2021 | Matsuo | B23K 20/12 |
| 2013/0098316 | A1 * | 4/2013 | Stan | F02F 3/003 123/41.35 |
| 2013/0104838 | A1 | 5/2013 | Spangenberg | |
| 2014/0102294 | A1 * | 4/2014 | Klein | F02F 3/22 29/888.044 |
| 2015/0184643 | A1 * | 7/2015 | Cooke | H02N 11/00 60/200.1 |
| 2016/0102596 | A1 * | 4/2016 | Vaden | F02F 3/22 123/41.35 |
| 2018/0334992 | A1 * | 11/2018 | Matsuo | F02F 3/003 |
| 2022/0307444 | A1 * | 9/2022 | Jung | F16J 1/09 |

FOREIGN PATENT DOCUMENTS

| | | | |
|---|---|---|---|
| CN | 106285999 | A | 1/2017 |
| DE | 102011115826 | A1 | 4/2013 |
| DE | 102017203433 | A1 | 9/2018 |

OTHER PUBLICATIONS

Chinese Office Action dated Aug. 23, 2022 for copending Chinese App. No CN202011032575.3 (w_English_translation).

English translation of CN Office Action dated Feb. 15, 2023 for CN-202011032575.3.

* cited by examiner

PISTON FOR SPLITTING INTERNAL COOLING RUNNER

CROSS-REFERENCE TO RELATED APPLICATION

This application claims priority to Chinese Application No. 202011032575.3 filed on Sep. 27, 2020, the contents of which are hereby incorporated by reference in its entirety.

TECHNICAL FIELD

The present disclosure relates to the field of engine, more particularly to a piston with a splitting internal cooling runner for an engine.

BACKGROUND

With the increasingly stringent requirements on motor vehicle exhaust emissions, the fuel consumption of motor vehicles under comprehensive working conditions is expected to be lower than a certain limit value, especially in the field of trucks.

Increasing the compression ratio of the engine can improve the combustion efficiency, and thus achieve the purpose of saving fuel and reducing carbon dioxide emissions. However, a larger compression ratio usually requires a smaller combustion chamber of the piston, which will lead to an excessively wide internal cooling runner of the piston and is consequently unfavorable to the strength of certain critical components of the internal cooling runner.

FIGS. 1 to 3 show schematic views of three types of possible internal cooling runner 10 of a piston P. The internal cooling runner 10 can cool a combustion chamber located at its radially inner side and an annular groove located at its radially outer side.

In the case of the size of the combustion chamber kept small, the internal cooling runner will usually be close to the combustion chamber and away from the outer peripheral wall of the piston if the width of the internal cooling runner is reduced, which will easily cause insufficient cooling of the throat or the ring bank.

Therefore, the technical problem expected to be solved in this field is providing an internal cooling runner which achieves efficient cooling on both the inner and outer peripheral sides.

SUMMARY

An object of the present disclosure is to overcome or at least alleviate the aforementioned problems of the prior art, and to provide a piston with a splitting internal cooling runner.

The present disclosure provides a piston with a splitting internal cooling runner, one end portion of the piston in an axial direction being recessed inward to form a combustion chamber, an annular internal cooling runner at least partially surrounding the combustion chamber being formed in the piston, wherein a wall of the internal cooling runner in vicinity of the end portion in the axial direction partially protrudes in a direction away from the end portion to form an annular splitting portion which divides the internal cooling runner into an outer half cavity and an inner half cavity that communicate with each other, wherein the outer half cavity is arranged on an outer peripheral side of the splitting portion, and the inner half cavity is arranged on an inner peripheral side of the splitting portion, and in the axial direction, a distance from a cavity top portion of the internal cooling runner closest to the end portion to an overhanging end of the splitting portion away from the end portion forms a height of the splitting portion, and a distance from the cavity top portion to a cavity bottom portion of the internal cooling runner farthest from the end portion forms a height of the runner, the height of the splitting portion occupies 20% to 75% of the height of the runner.

In at least one embodiment, a ratio of the height of the splitting portion to the height of the runner is greater than or equal to 50%.

In at least one embodiment, a thickness of the splitting portion in a radial direction of the piston increases toward the end portion in the axial direction.

In at least one embodiment, an outer side wall of the splitting portion facing the outer half cavity inclines to the outer peripheral side while extending toward the end portion in the axial direction, and/or an inner side wall of the splitting portion facing the inner half cavity inclines to the inner peripheral side while extending toward the end portion in the axial direction.

In at least one embodiment, the outer side wall at least partially constitutes a part of a first virtual conical surface, and an included angle between a generatrix of the first virtual conical surface and the axial direction is 10 to 30 degrees.

In at least one embodiment, the inner side wall at least partially constitutes a part of a second virtual conical surface, and an included angle between a generatrix of the second virtual conical surface and the axial direction is 10 to 30 degrees.

In at least one embodiment, in a radial direction of the piston, a distance from the overhanging end of the splitting portion away from the end portion in the axial direction to a radially outermost wall of the outer half cavity forms a width of the outer half cavity, and a distance from the overhanging end to a radially innermost wall of the inner half cavity forms a width of the inner half cavity, wherein a ratio of the width of the outer half cavity to the width of the inner half cavity is not less than 0.5 and not more than 2.

In at least one embodiment, the cavity bottom portion of the internal cooling runner away from the end portion in the axial direction does not protrude toward the splitting portion.

In at least one embodiment, the piston comprises a first portion of the piston and a second portion of the piston, and the splitting portion is arranged in the second portion of the piston, and the first portion of the piston and the second portion of the piston are configured to be spliced together to form the piston, and two surfaces of the second portion of the piston for splicing with the first portion of the piston are arranged at the inner peripheral side and the outer peripheral side of the splitting portion, respectively.

In at least one embodiment, the splitting portion is formed by machining.

The piston with the splitting internal cooling runner according to the present disclosure is simple in structure and can provide a uniform cooling effect for the annular groove and the combustion chamber.

LIST OF THE REFERENCE SIGNS

P piston; P1 first portion of piston; P2 second portion of piston;

10 internal cooling runner; 101 cavity top portion; 102 cavity bottom portion;

103 outer peripheral wall; 104 inner peripheral wall;

11 outer half cavity; 12 inner half cavity

20 splitting portion; 21 outer side wall; 22 inner side wall; 201 overhanging end;

C0 combustion chamber; C1, C2, C3 annular groove;

W1 width of outer half cavity; W2 width of inner half cavity;

h1 height of splitting portion; h2 height of runner;

A axial direction; R radial direction.

BRIEF DESCRIPTION OF THE DRAWINGS

Exemplary embodiments of the present disclosure are described below with reference to the drawings. It is understood that these specific descriptions only serve the purpose of teaching those skilled in the art how to implement the present disclosure, and are not intended to exhaust all the possible implementation modes of the present disclosure, nor to limit the scope of the present disclosure.

Referring to FIGS. 4 to 7, a piston with a splitting internal cooling runner according to the present disclosure will be described. Unless otherwise specified, referring to FIG. 5, A represents the axial direction of the piston and R represents the radial direction of the piston. In the present disclosure, the positional relationship among the respective components is illustrated by the up-down relationship shown in FIGS. 4 to 7. It is understood that the up-down positional relationship among the components in the present disclosure is a relative positional relationship, and the positional coordinates can be spatially rotated according to the actual application site of the device.

Figure 4:
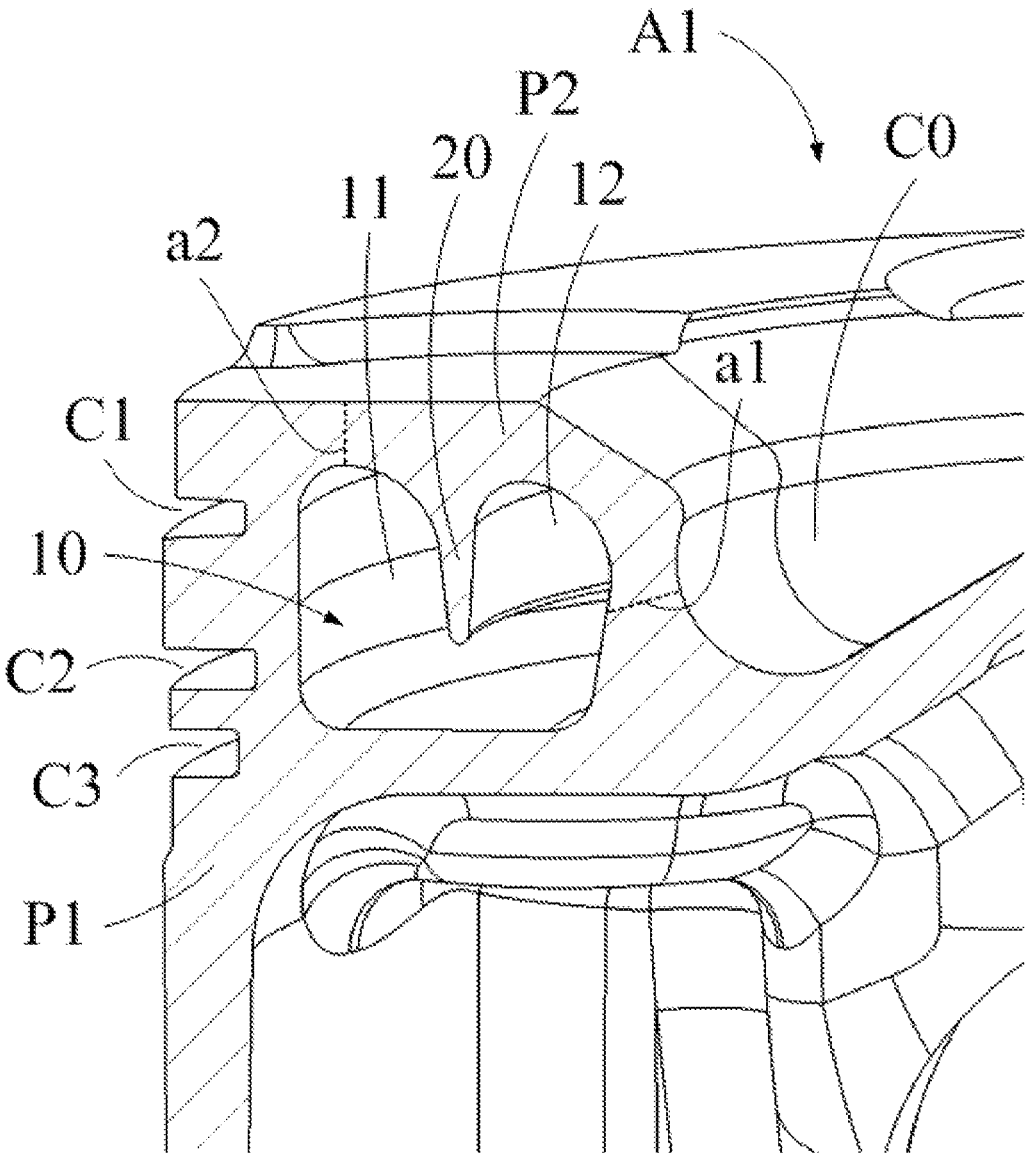
FIGS. 4 and 5 show a part of schematic views of a piston with a splitting internal cooling runner according to one embodiment of the present disclosure cut away in the axial direction.

Referring to FIG. 4, one end A1 of the piston according to the present disclosure in the axial direction is recessed in the axial direction A to form a combustion chamber C0. An internal cooling runner 10 which is formed as an annular cavity inside the piston is formed on an outer peripheral side of the combustion chamber C0. In the axial direction A, the internal cooling runner 10 at least partially overlaps the combustion chamber C0 and at least partially overlaps at least one annular groove (at least one of annular grooves C1, C2 and C3). The wall of the internal cooling runner 10 has at least one inlet and at least one outlet (not shown) thereon. Cooling liquid such as engine oil can flow in via the inlet of the internal cooling runner 10 and flow out from the outlet of the internal cooling runner 10, and thus providing a flowing cooling liquid for the internal cooling runner 10.

In the axial direction A, a wall of the internal cooling runner 10 in vicinity of the end portion A1 partially protrudes in a direction away from the end portion A1 so as to form an annular splitting portion 20 which divides the internal cooling runner 10 into an outer half cavity 11 and an inner half cavity 12. The outer half cavity 11 is arranged at the outer periphery side of the splitting portion 20, and the inner half cavity 12 is arranged at the inner periphery side of the splitting portion 20. The outer half cavity 11 and the inner half cavity 12 are separated by the splitting portion 20 at an upper part (the part in vicinity of the end portion A1), and the outer half cavity 11 and the inner half cavity 12 communicate with each other at a lower part.

Since the internal cooling runner 10 is partially separated by the splitting portion 20, the cooling liquid flowing into the internal cooling runner 10 will be divided into two liquid flows with different flow directions in the internal cooling runner 10.

Figure 5:
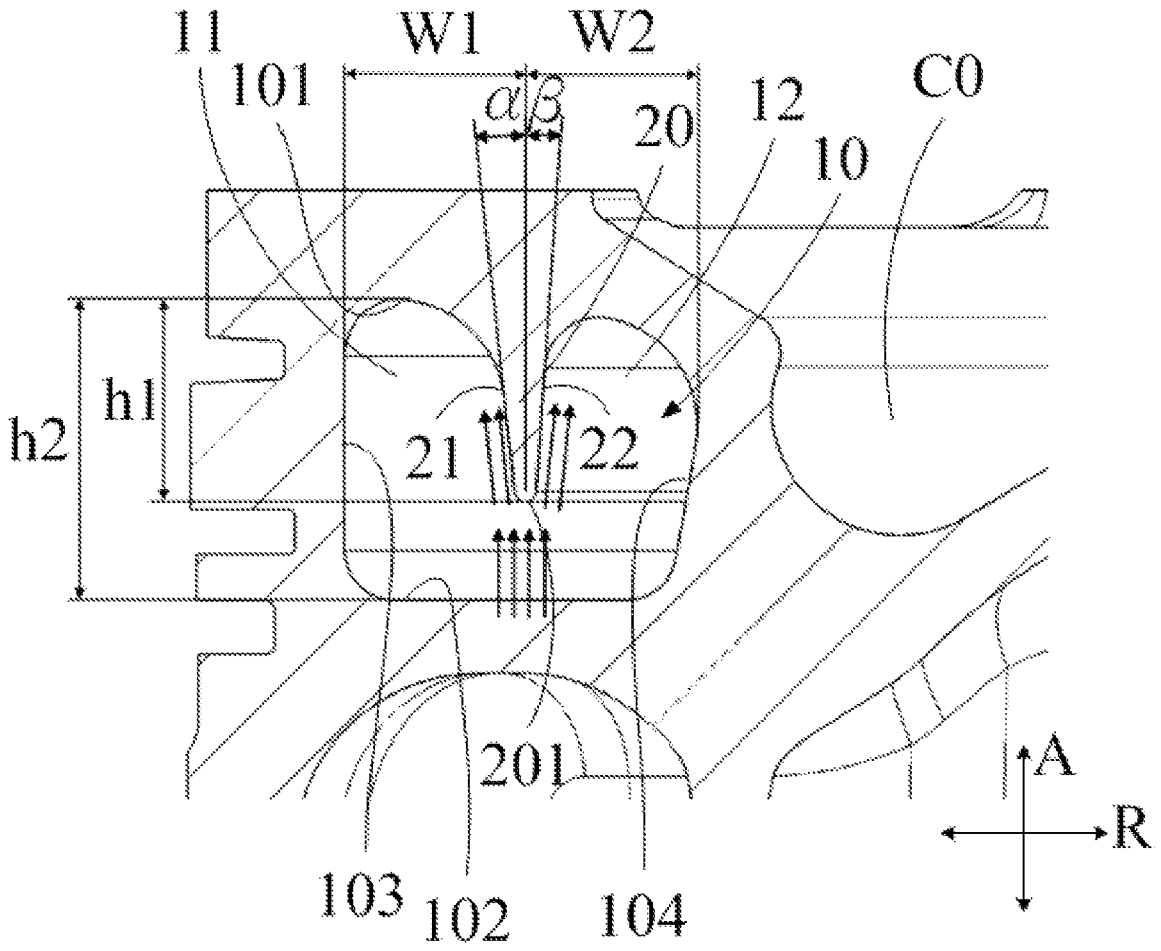

The unidirectional arrows in FIG. 5 indicate the flow direction of the cooling liquid in vicinity of the splitting portion 20. For example, the inlet of the internal cooling runner 10 is disposed at a cavity bottom portion 102 which is away from the end portion A1 in the axial direction A. The cooling liquid flowing into the internal cooling runner 10 via the inlet will be divided into two liquid flows when reaching the splitting portion 20. One liquid flow flows to the outer half cavity 11 and can continue flowing to an outer peripheral wall 103 of the internal cooling runner 10, forming a counterclockwise vortex in FIG. 5 to cool the annular groove; and the other liquid flow flows to the inner half cavity 12 and can flow to an inner peripheral wall 104 of the internal cooling runner 10, forming a clockwise vortex in FIG. 5 to cool the combustion chamber C0.

In order to achieve a better diversion effect, the dimensional relationship between the internal cooling runner 10 and the splitting portion 20 will be described below.

With reference to FIG. 5, in the axial direction A, a distance from the upper wall of the internal cooling runner 10 closest to the end portion A1, i.e., the cavity top portion 101, to the overhanging end 201 of the splitting portion 20 away from the end portion A1 forms a height h1 of the splitting portion, and a distance from the cavity top portion 101 to the lower wall of the internal cooling runner 10 farthest from the end portion A1, i.e., the cavity bottom portion 102, forms a height h2 of the runner. Preferably, the height h1 of the splitting portion occupies 20% to 75% of the height h2 of the runner, i.e., $20\% \leq h1/h2 \leq 75\%$. More preferably, the ratio of the height h1 of the splitting portion to the height h2 of the runner is greater than or equal to 50%, i.e., $h1/h2 \geq 50\%$.

The thickness of the splitting portion 20 in the radial direction R of the piston increases toward the end portion A1 in the axial direction A. Preferably, the outer side wall 21 of the splitting portion 20 facing the outer half cavity 11 inclines to the outer peripheral side while extending toward the end portion A1 in the axial direction A, and the inner side wall 22 of the splitting portion 20 facing the inner half cavity 12 inclines to the inner peripheral side while extending toward the end portion A1 in the axial direction A.

Preferably, the outer side wall 21 at least partially constitutes a part of a first virtual conical surface, and an included angle $\alpha$ between a generatrix of the first virtual conical surface and the axial direction A is 10 to 30 degrees; the inner side wall 22 at least partially constitutes a part of a second virtual conical surface, and an included angle $\beta$ between a generatrix of the second virtual conical surface and the axial direction A is 10 to 30 degrees.

According to the specific dimensions of the piston, the combustion chamber C0 and the annular groove on the piston, the included angles α and β can be adaptively adjusted, so as to adjust the flow direction of the cooling liquid, and make the cooling liquid stay at a specific position for a long period of time according to the design requirements, thereby enhancing the cooling effect at respective position.

In the radial direction R of the piston, a distance from the overhanging end 201 of the splitting portion 20 away from the end portion A1 in the axial direction A to a radially outermost wall of the outer half cavity 11, i.e., the outer peripheral wall 103, forms a width W1 of the outer half cavity, and a distance from the overhanging end 201 to a radially innermost wall of the inner half cavity 12, i.e., the inner peripheral wall 104, forms a width W2 of the inner half cavity. Preferably, the ratio of the width W1 of the outer half cavity to the width W2 of the inner half cavity is not less than 0.5 and not more than 2, i.e., $0.5 \leq W1/W2 \leq 2$.

According to the specific dimensions of the piston, the combustion chamber C0 and the annular groove on the piston, the ratio of the width W1 of the outer half cavity to the width W2 of the inner half cavity can be adaptively adjusted, such that different amounts and flow rates of the cooling liquid are assigned to the outer half cavity 11 and the inner half cavity 12 to balance the cooling effect on the annular groove and the combustion chamber C0.

Preferably, in the axial direction A, the cavity bottom portion 102 of the internal cooling runner 10 does not protrude toward the splitting portion 20.

It is worth noting that the area of the walls of the internal cooling runner 10 is increased while the number of the splitting portions 20 is increased, that is, the heat dissipation area of the internal cooling runner 10 is increased. Therefore, in this regard, the splitting portion 20 also plays a role in improving the heat dissipation efficiency.

Back to FIG. 4, the fabrication method of the piston according to the present disclosure will be described as follows.

In order to facilitate the formation of the internal cooling runner 10, or to facilitate the formation of the splitting portion 20, the piston comprises two spliced portions, namely a first portion P1 of the piston and a second portion P2 of the piston, and the splitting portion 20 is located in the second portion P2 of the piston.

The second portion P2 of the piston is annular, and has two surfaces spliced with the first portion P1 of the piston, namely a splicing surface a1 and a splicing surface a2. The splicing surface a1 is located at the inner peripheral side of the splitting portion 20, and the splicing surface a2 is located at the outer peripheral side of the splitting portion 20.

Specifically, in the embodiment shown in FIG. 4, the splicing surface a1 is located at the inner peripheral side of the inner half cavity 12, and the splicing surface a2 is located at the upper part of the outer half cavity 11 in vicinity of the end portion A1.

The splitting portion 20 may be formed by machining the second portion P2 of the piston.

Preferably, the first portion P1 of the piston and the second portion P2 of the piston are connected together by a welding process, for example, friction welding or laser welding is employed to weld the splicing surface a1 and the splicing surface a2 with the corresponding surfaces on the first portion P1 of the piston, respectively.

It is understood that in the case of the splitting portion 20 located in the second portion P2 of the piston, the specific positions of the splicing surfaces a1 and a2 of the second portion P2 of the piston are not limited in the present disclosure.

Figure 6:
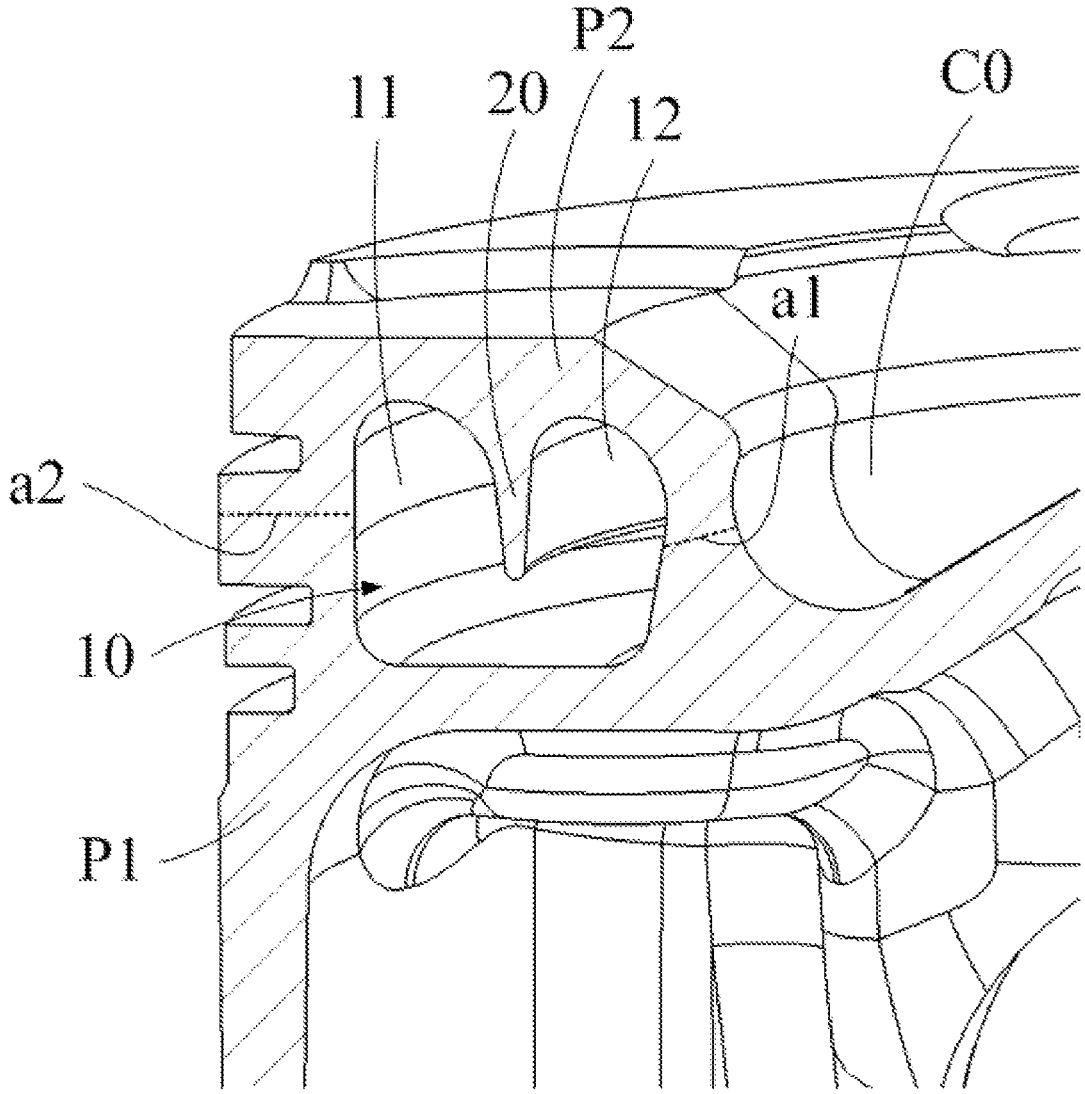
FIG. 6 shows a part of an schematic view of a piston with a splitting internal cooling runner according to another embodiment of the present disclosure cut away in the axial direction.

For example, referring to FIG. 6, the splicing surface a2 may also be located on the outer peripheral side of the outer half cavity 11.

It is understood that in other possible embodiments, the splicing surface a1 may also be located at the upper part of the inner half cavity 12 in vicinity of the end portion A1.

It is understood that the specific shapes of the outer peripheral wall 103 and the inner peripheral wall 104 of the internal cooling runner 10 are not limited in the present disclosure.

Figure 7:
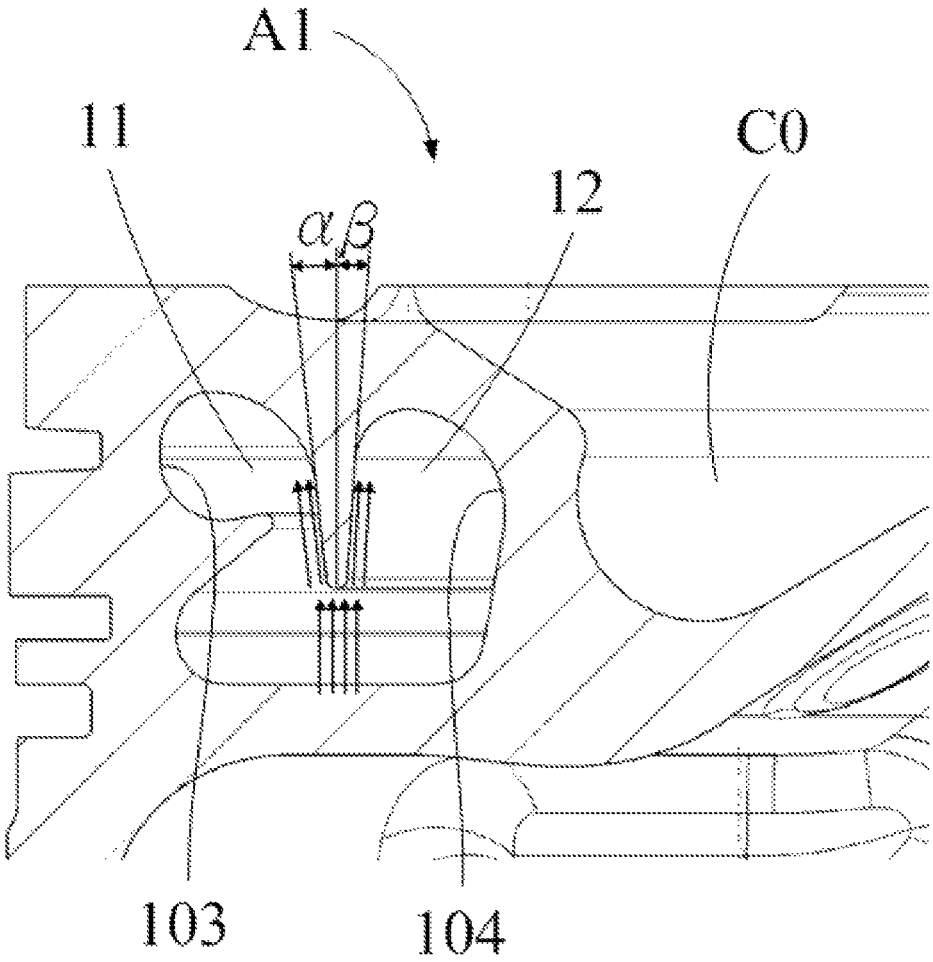
FIG. 7 shows a part of an schematic view of a piston with a splitting internal cooling runner according to yet another embodiment of the present disclosure cut away in the axial direction.

For example, referring to FIG. 7, the outer peripheral wall 103 may also partially protrude radially inward, such that the outer half cavity 11 is formed into a substantially waist shape in the section along the axial direction A to, for example, guide the cooling liquid to stay in the region of the outer half cavity 11 in vicinity of the end portion A1 for a longer period of time.

Figure 1:
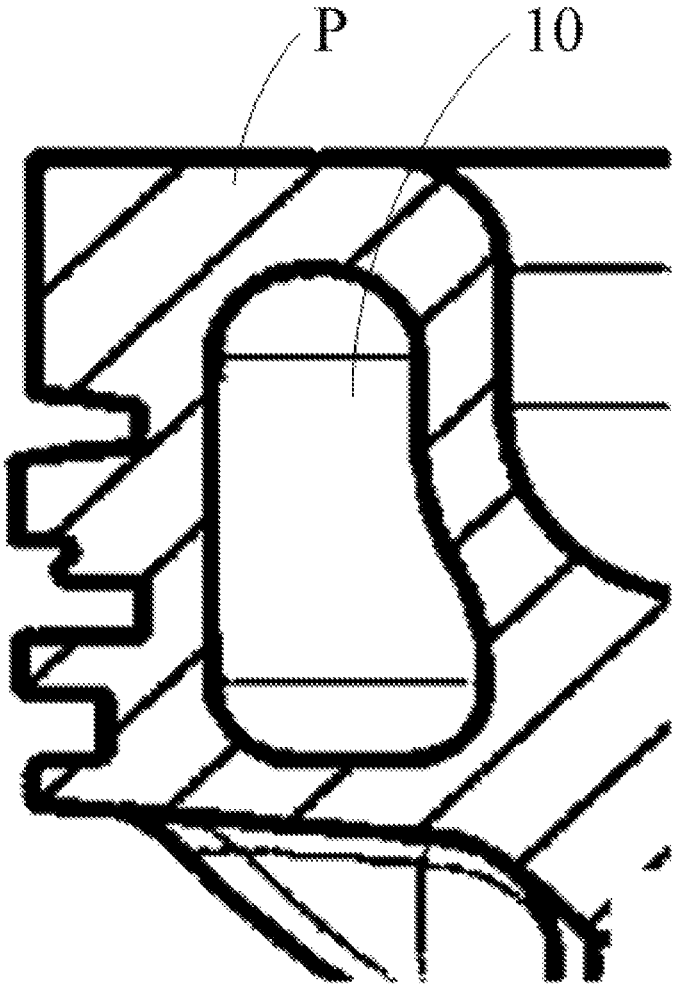
FIGS. 1 to 3 show a part of the axial sectional views of three types of possible piston provided with an internal cooling runner.
Figure 2:
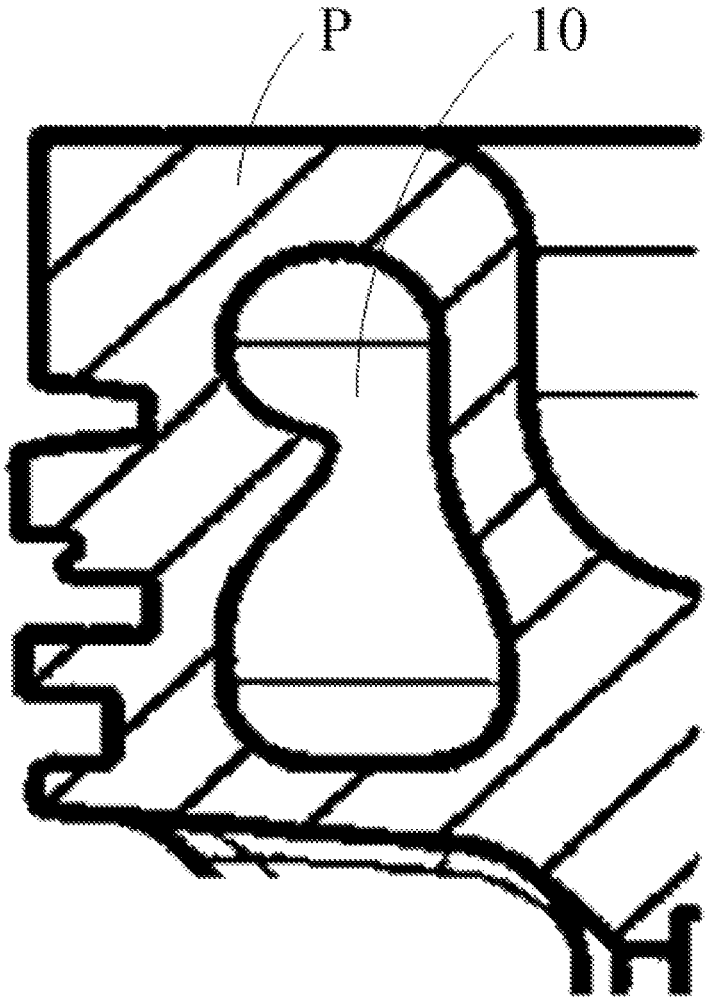
Figure 3:
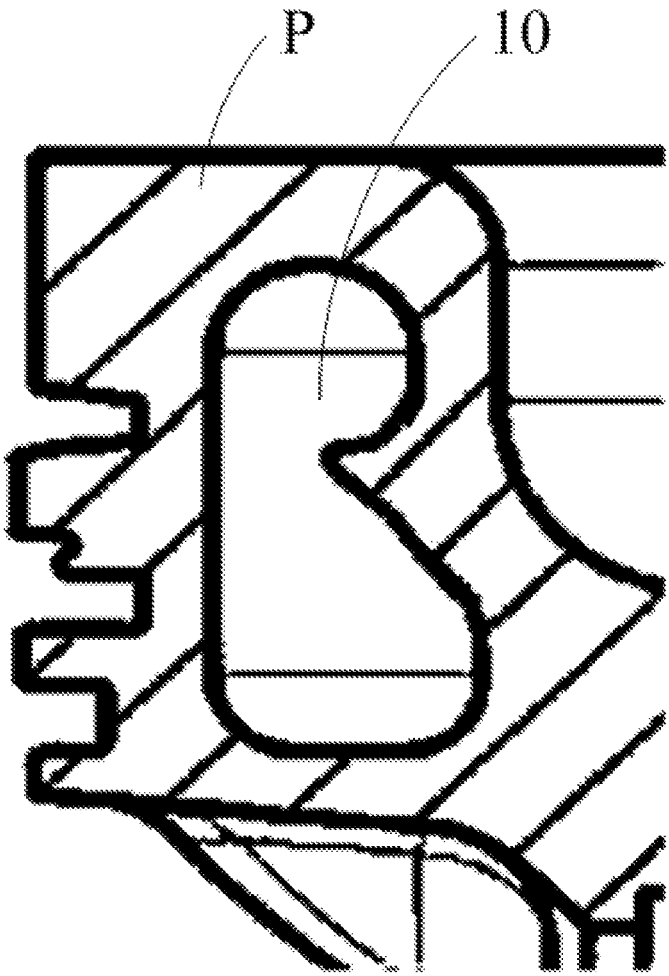

It is understood that in other possible embodiments, the inner peripheral wall 104 may also partially protrude radially outward, such that the inner half cavity 12 is formed into a substantially waist shape in the section along the axial direction A (see FIG. 3).

The present disclosure has at least one of the following advantages:

(i) the internal cooling runner 10 of the piston according to the present disclosure has the function of adjusting the flow direction of the cooling liquid to form at least two vortexes in different directions in the internal cooling runner 10, such that the cooling liquid is distributed to the outer half cavity 11 in vicinity of the annular groove and the inner half cavity 12 in vicinity of the combustion chamber C0 as required, thereby balancing the cooling effect on the annular groove and the combustion chamber C0;

(ii) the width of the internal cooling runner 10 of the piston according to the present disclosure is reasonable, which can provide sufficient cooling effect. Meanwhile, the provision of the splitting portion 20 can ensure that the strength of the piston does not deteriorate; and (iii) the piston according to the present disclosure is simple in structure and convenient to fabricate.

The present disclosure is not limited to the above-mentioned embodiments. Those skilled in the art can make various modifications to the above-mentioned embodiments under the teaching of the present disclosure without departing from the scope of the present disclosure.

What is claimed is:

1. A piston, comprising:

a splitting annular internal cooling runner; and an end portion in an axial direction recessed inward to form a combustion chamber, the annular internal cooling runner at least partially surrounds the combustion chamber;

wherein a wall of the annular internal cooling runner in a vicinity of the end portion, in the axial direction, partially protrudes in a direction away from the end portion to form an annular splitting portion which divides the annular internal cooling runner into an outer half cavity and an inner half cavity that communicate with each other;

wherein the outer half cavity is arranged on an outer peripheral side of the splitting portion, and the inner half cavity is arranged on an inner peripheral side of the splitting portion;

wherein in the axial direction, a distance from a cavity top portion of the annular internal cooling runner closest to the end portion to an overhanging end of the splitting portion away from the end portion forms a height of the splitting portion, and a distance from the cavity top portion to a cavity bottom portion of the annular internal cooling runner farthest from the end portion forms a height of the runner, the height of the splitting portion occupies approximately 20% to 75% of the height of the runner;

wherein an inner side wall of the splitting portion facing the inner half cavity inclines to the inner peripheral side while extending toward the end portion in the axial direction and the inner side wall extends toward the cavity bottom portion;

wherein an outer peripheral wall of the internal cooling runner includes a protrusion that extends inwardly, the protrusion is spaced apart from the bottom cavity portion by a first distance and the overhanging end of the splitting portion is spaced apart from the bottom cavity portion by a second distance, and the first distance is greater than the second distance; and wherein the protrusion and the splitting portion are configured to guide at least some of a cooling liquid to stay in a region of the outer half cavity adjacent the end portion.

2. The piston according to claim 1, wherein a ratio of the height of the splitting portion to the height of the runner is greater than or equal to 50%.

3. The piston according to claim 1, wherein the protrusion extends from the outer peripheral wall towards the splitting portion.

4. The piston according to claim 1, wherein the protrusion extends from the outer peripheral wall towards a middle portion of the splitting portion.

5. The piston according to claim 1, wherein the outer side wall at least partially constitutes a part of a first virtual conical surface, and an included angle between a generatrix of the first virtual conical surface and the axial direction is 10 to 30 degrees.

6. The piston according to claim 1, wherein the inner side wall at least partially constitutes a part of a second virtual conical surface, and an included angle between a generatrix of the second virtual conical surface and the axial direction is 10 to 30 degrees.

7. The piston according to claim 1, wherein in a radial direction of the piston, a distance from the overhanging end of the splitting portion away from the end portion in the axial direction to a radially outermost wall of the outer half cavity forms a width of the outer half cavity, and a distance from the overhanging end to a radially innermost wall of the inner half cavity forms a width of the inner half cavity, wherein a ratio of the width of the outer half cavity to the width of the inner half cavity is not less than 0.5 and not more than 2.

8. The piston according to claim 1, wherein the cavity bottom portion of the annular internal cooling runner away from the end portion in the axial direction does not protrude toward the splitting portion.

9. The piston according to claim 1, wherein the piston comprises a first portion of the piston and a second portion of the piston, and the splitting portion is arranged in the second portion of the piston; and the first portion of the piston and the second portion of the piston are spliced together via a first splicing surface and a second splicing surface to form the piston, the first splicing surface is located at an inner peripheral side of the inner half cavity and the second splicing surface is located at an uppermost part of the outer half cavity.

10. The piston according to claim 9, wherein the splitting portion is formed by machining.

11. A piston, comprising:

a splitting annular internal cooling runner; and a combustion chamber;

wherein the annular internal cooling runner at least partially surrounds the combustion chamber;

wherein a wall of the annular internal cooling runner forms an annular splitting portion which divides the annular internal cooling runner into an outer half cavity and an inner half cavity;

wherein the splitting portion is configured to divide a cooling liquid flowing through the annular internal cooling runner into two liquid flows with different flow directions in the annular internal cooling runner;

wherein an outer peripheral wall of the internal cooling runner includes a protrusion that extends inwardly, an end of the splitting portion is disposed closer to a bottom cavity portion of the runner than the protrusion; and wherein the protrusion and the splitting portion are configured to guide at least some of the cooling liquid to stay in a region of the outer half cavity adjacent the end portion.

12. The piston according to claim 11, wherein a ratio of a height of the splitting portion to a height of the runner is greater than or equal to 50%.

13. The piston according to claim 11, wherein a thickness of the splitting portion in a radial direction of the piston increases toward an end portion in an axial direction.

14. The piston according to claim 11, wherein an outer side wall of the splitting portion facing the outer half cavity inclines to an outer peripheral side while extending toward an end portion in an axial direction; and an inner side wall of the splitting portion facing an inner half cavity inclines to an inner peripheral side while extending toward the end portion in the axial direction and the inner side wall extends toward a bottom of the annular internal cooling runner.

15. The piston according to claim 14, wherein the outer side wall at least partially constitutes a part of a first virtual conical surface, and an included angle between a generatrix of the first virtual conical surface and the axial direction is 10 to 30 degrees.

16. The piston according to claim 14, wherein the inner side wall at least partially constitutes a part of a second virtual conical surface, and an included angle between a generatrix of the second virtual conical surface and the axial direction is 10 to 30 degrees.

17. The piston according to claim 11, wherein in a radial direction of the piston, a distance from an overhanging end of the splitting portion away from an end portion in an axial direction to a radially outermost wall of the outer half cavity forms a width of the outer half cavity, and a distance from the overhanging end to a radially innermost wall of the inner half cavity forms a width of the inner half cavity, wherein a ratio of the width of the outer half cavity to the width of the inner half cavity is not less than 0.5 and not more than 2.

18. The piston according to claim 11, wherein a cavity bottom portion of the annular internal cooling runner away from an end portion in an axial direction does not protrude toward the splitting portion.

19. The piston according to claim 11, wherein the piston comprises a first portion and a second portion, and the splitting portion is arranged in the second portion; and the first portion and the second portion are spliced together via a first splicing surface and a second splicing surface to form the piston, the first splicing surface is located at an inner peripheral side of the inner half cavity and the second splicing surface is located at an uppermost part of the outer half cavity.

20. The piston according to claim 11, wherein the splitting portion is formed by machining.

* * * * *